US010711986B1

(12) United States Patent
Yang et al.

(10) Patent No.: US 10,711,986 B1
(45) Date of Patent: Jul. 14, 2020

(54) LAMP BODY STRUCTURE AND PANEL LAMP WITH POSITIONING GROOVE AND POWER SUPPLY ASSEMBLY THEREIN

(71) Applicant: LONGHORN INTELLIGENT TECH CO., LTD, Shenzhen (CN)

(72) Inventors: Haitao Yang, Shenzhen (CN); Lin Yang, Shenzhen (CN); Min Liu, Shenzhen (CN); Lei Li, Shenzhen (CN)

( * ) Notice: Subject to any disclaimer, the term of this patent is extended or adjusted under 35 U.S.C. 154(b) by 0 days.

(21) Appl. No.: 16/517,352

(22) Filed: Jul. 19, 2019

Related U.S. Application Data

(63) Continuation-in-part of application No. PCT/CN2019/087817, filed on Jun. 6, 2019.

(30) Foreign Application Priority Data

May 21, 2019 (CN) ..... 2019 2 0738978 U
Jun. 6, 2019 (WO) ..... PCT/CN2019/087817

(51) Int. Cl.

| | |
|---|---|
| ***F21V 23/00*** | (2015.01) |
| ***F21V 23/02*** | (2006.01) |
| ***F21V 15/01*** | (2006.01) |
| ***F21V 17/12*** | (2006.01) |
| ***F21K 9/20*** | (2016.01) |
| *F21Y 115/10* | (2016.01) |
| *F21Y 105/10* | (2016.01) |
| *F21Y 105/16* | (2016.01) |
| *F21Y 105/00* | (2016.01) |

(52) U.S. Cl.
CPC ..... *F21V 23/023* (2013.01); *F21K 9/20* (2016.08); *F21V 15/01* (2013.01); *F21V 17/12* (2013.01); *F21V 23/007* (2013.01); *F21Y 2105/00* (2013.01); *F21Y 2105/10* (2016.08); *F21Y 2105/16* (2016.08); *F21Y 2115/10* (2016.08)

(58) Field of Classification Search
CPC ..... F21V 15/01; F21V 15/02; F21V 23/007–009; F21V 23/023; F21V 17/12
See application file for complete search history.

(56) References Cited

U.S. PATENT DOCUMENTS

2014/0313780 A1* 10/2014 Myers ..... F21V 23/006 362/646
2015/0252965 A1* 9/2015 Edwards ..... F21V 9/30 362/84

(Continued)

*Primary Examiner* — Evan P Dzierzynski
*Assistant Examiner* — Keith G. Delahoussaye
(74) *Attorney, Agent, or Firm* — Clement Cheng

(57) ABSTRACT

The lamp body structure includes a lamp panel and a power component. The lamp panel comprises a bottom plate and a plurality of side plates connected end to end. The bottom plate and each side plate together form a positioning cavity for the light source assembly, wherein the one side plate is located at the edge of the plate at the opening of the cavity and is disposed away from the bottom plate. The direction of the cavity extends and forms a support plate, and the support plate and the corresponding side plate together form a seating groove. The power component is connected to an external power source and supplies power to the light source component. One end of the power component is inserted into the mounting groove along the corresponding side plate and abuts the support plate.

19 Claims, 5 Drawing Sheets

(56) References Cited

U.S. PATENT DOCUMENTS

| | | | | |
|---|---|---|---|---|
| 2016/0091181 | A1* | 3/2016 | Scribante | F21V 21/04<br>362/220 |
| 2019/0086058 | A1* | 3/2019 | Lim | F21V 7/0033 |
| 2019/0323693 | A1* | 10/2019 | Bowser | F21V 33/00 |

* cited by examiner

LAMP BODY STRUCTURE AND PANEL LAMP WITH POSITIONING GROOVE AND POWER SUPPLY ASSEMBLY THEREIN

This application claims priority from earlier filed PCT application number PCT/CN2019/087817 entitled Lamp Body Structure And Panel Lamp by applicant Longhorn Intelligent Tech Co., Ltd. filed Jun. 6, 2019 having the same inventors. This application also claims priority from China Utility Model 201920738978.6 entitled Lamp Body Structure And Panel Lamp by applicant Longhorn Intelligent Tech Co., Ltd. filed May 21, 2019, also having the same inventors.

FIELD OF THE INVENTION

The present invention relates to the field of lighting technologies, and in particular, to a lamp body structure and a panel lamp.

BACKGROUND

At present, the direct-illuminated panel light on the market generally uses a metal shell power supply with a plurality of wiring holes, and the panel light can be connected to the power source through the metal shell power supply assembly. Different regions have different requirements for the location setting of power components. In the US market, metal shell power components are required to be fixed to the lamp body. The structure of the metal shell power module installed on the US market is to fix an adapter plate on the back of the lamp body, lead the positive and negative lines of the panel lamp, and then mount the metal shell power component on the adapter board. A disadvantage of this construction is that it leads to an excessive thickness of the entire lamp body. Because the thickness of the lamp body of the direct-illuminated panel lamp is generally about 35 mm, if the power component is mounted on the back of the lamp body, the overall thickness of the panel lamp will reach about 70 mm. This is neither aesthetically pleasing nor good for the cost of packaging.

SUMMARY OF THE INVENTION

It is a primary object of the present invention to provide a lamp body structure that aims to solve the problem of how to reduce the overall thickness of the panel lamp while maintaining rigidity. The present invention provides a lamp body structure for mounting a light source assembly and supplying power to the light source assembly. The lamp body structure includes a bottom plate and side plates connected end to end. The bottom plate and each of the side plates together form a positioning cavity in an open cavity structure and for mounting the light source assembly. The side plate is located in the placement a plate edge at the cavity opening extending parallel to the bottom plate and away from the seating cavity and forming a support plate. The support plate and the corresponding side plate together forming a seating groove. A power supply assembly connects the external power supply and supplies power to the light source assembly. One end of the power supply assembly is inserted into the positioning groove along the corresponding side plate and abuts the support plate.

In one embodiment, the angle between the support plate and the corresponding side plate in the seating groove is greater than 90° and less than 180°.

In one embodiment, the number of the support plates is matched with the number of the side plates, and each of the support plates is respectively connected to one of the side plates and the mounting groove is formed between the corresponding side plates.

In one embodiment, the power supply assembly includes a power supply box and a power supply circuit board that connects the external power supply and supplies power to the light source assembly. The power supply box is provided with a receiving cavity for mounting the power circuit board; The power supply box has a connection surface to which the support plate is connected, and a wiring surface that is disposed opposite to the connection surface and that is connected to the power supply circuit board by an external wire. In one embodiment, the outer panel of the bottom plate is disposed face up, the wiring surface being no higher than the outer panel surface of the bottom panel.

In one embodiment, the power supply assembly further includes a first junction box on one side of the lamp panel which has a first wiring compartment. The first junction box connects to an outer panel surface of one of the side panels. The first terminal block has an open structure and an external wire passes through to electrically connect to the power circuit board, and the first junction box is provided with at least external wire that passes through to electrically connect to the power circuit board. In one embodiment, the power supply assembly further includes a wiring cover that covers the opening of the first wiring compartment, the wiring cover is for retaining an external wire.

In one embodiment, the outer surface of the wiring cover is not higher than the outer surface of the bottom plate. In one embodiment, the opening edge of the terminal compartment is provided with a first threaded hole, and one end of the wiring cover is provided with a second threaded hole corresponding to the position of the first threaded hole. The power component further includes a screw end, and a positioning bolt is locked to the first threaded hole and the second threaded hole. In one embodiment, the wiring cover is provided with a first wiring hole that communicates with the first wiring compartment and is used for external wires to pass through. The first wiring holes are disposed in pairs.

In one embodiment, the wiring cover is further provided with a ground screw hole that communicates with the first terminal block, and the ground screw hole is spaced apart from the first wiring hole.

In one embodiment, the first junction box is provided in a pair, such that two first junction boxes are respectively connected to end faces of the two ends of the power supply box and are located in the positioning slot. Also, the receiving cavity is located at two places between the first wiring compartments.

In one embodiment, the opening of each of the first terminal compartments is covered by the wiring cover. The power supply assembly further includes a second junction box detachably connecting the wiring surface and having a second wiring compartment. The second junction box is used for electrically connecting an external power source to the power circuit board. The second junction box is stacked with the power supply box.

In one embodiment, the surface of the box of the second junction box is provided with a second wiring hole for fixing external wires arranged in pairs. In one embodiment, the power supply assembly further includes a ground stud that connects one of the surface of the second junction box and is connected by an external ground wire.

In one embodiment, the lamp body structure, the light source assembly, and the middle frame structure is according to any one of claims such that the light source assembly is disposed in the positioning cavity, and the middle frame structure is located in the placement. The opening of the cavity and the light source assembly are secured to the seating cavity.

In one embodiment, the light source assembly includes reflective paper, LED light-emitting strips, and diffusion plates disposed in the chamber. The LED light-emitting strips are spaced apart from each other, and each of the LED light-emitting strips is located at the reflector. Between the paper and the diffuser plate, the reflective paper (reflector) is coupled to a cavity bottom of the seating cavity. In one embodiment, the panel light further includes a hook for connecting the middle frame structure to an outer structural member. One end of the hook is connected to the middle frame structure, and the other end of the hook is connected to an outer portion of a structural member. The hook and the power supply assembly are located on the same side of the support plate. The technical effect of the invention is that the lamp tray is laid flat, and a fixing groove is formed between the supporting plate and the corresponding side plate. The groove depth of the positioning groove is coincident with the thickness of the lamp plate, and one end of the power component is placed in the positioning groove. Therefore, the thickness space of the lamp panel can be utilized, and the overall thickness of the panel lamp can be reduced, so that the overall structure of the panel lamp is more novel and simple, and also contributes to the packaging and transportation of the panel lamp.

Figure 1:
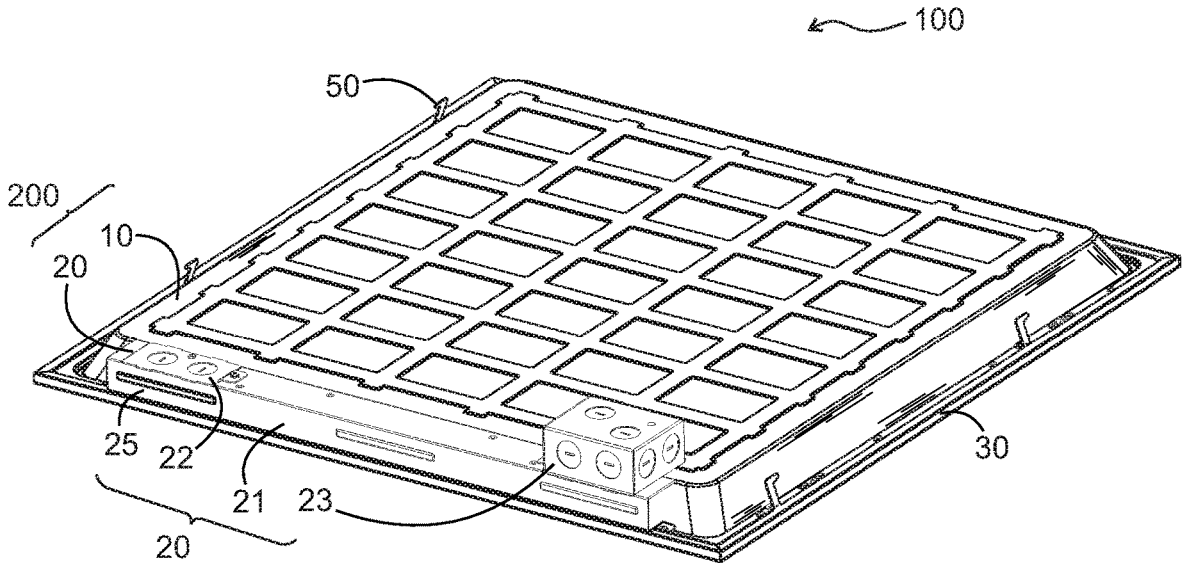
FIG. 1 is a perspective structural view of a panel light provided by an embodiment of the present invention.

The following call out list of elements can be a useful guide in referencing the elements of the drawings.

10 Lamp Panel
11 Bottom Plate
12 Side Plate
13 Support Plate
14 Placement Groove
20 Power Component
21 Power Box
22 Wiring Cover
23 Second Junction Box
24 Positioning Bolt
25 The First Junction Box
30 Middle Frame Structure
40 Light Source Assembly
41 Reflective Paper
42 Led Light Strip
43 Diffuser
50 Hook
100 Panel Light
111 Placement Cavity
200 Lamp Body Structure
211 First Wiring Compartment
221 First Wiring Hole
222 Grounding Screw Hole
223 Second Threaded Hole
224 First Threaded Hole
231 Ground Stud
232 Second Wiring Hole
260 Wiring Surface
421 Light-Emitting Circuit Board
422 Lens

DETAILED DESCRIPTION OF THE PREFERRED EMBODIMENT

The embodiments of the present invention are described in detail below, and the examples of the embodiments are illustrated in the drawings. The same or similar reference numerals are used to refer to the same or similar elements or elements having the same or similar functions. The embodiments described below with reference to the drawings are intended to be illustrative of the invention and are not to be construed as limiting.

In the description of the present invention, it is to be understood that the orientations or positional relationships indicated by the terms "thickness", "upper", "lower", "vertical", "parallel", "bottom", "corner", etc. are based on the orientation or positional relationship shown in the figures and is for the convenience of the description of the invention and the simplification of the description, and is not intended to indicate or imply that the device or component referred to has a specific orientation, or is constructed and operated in a specific orientation, and therefore cannot be construed as claim limitations of the invention.

In the present invention, the terms "installation", "connection" and the like are to be understood broadly, and may be, for example, a fixed connection, a detachable connection, or an integral body, unless otherwise specifically defined and defined. The connection may also be an electrical connection and may be directly connected or indirectly connected through an intermediate medium, and may be an internal connection of two elements or an interaction relationship of two elements.

Figure 2:
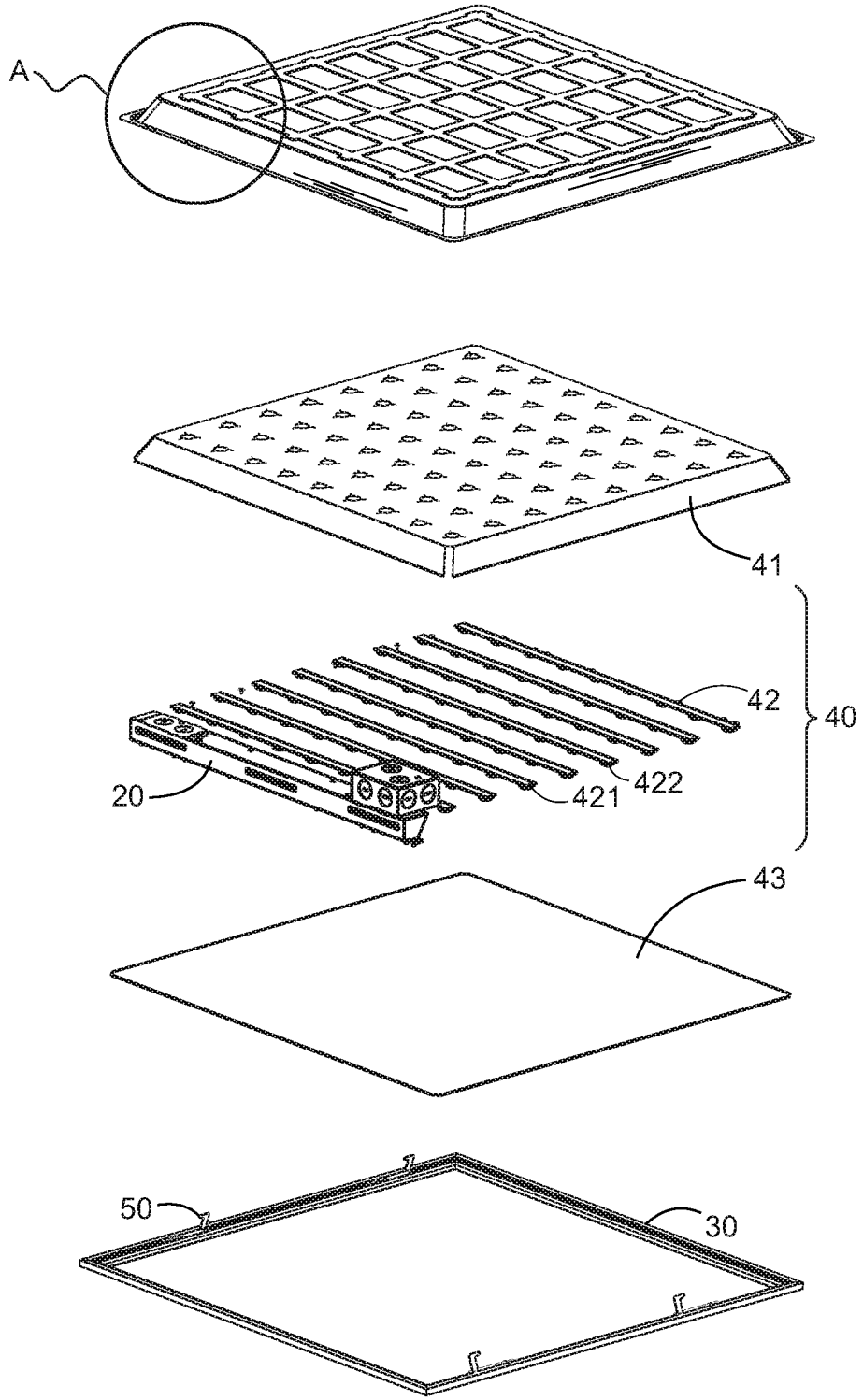
FIG. 2 is an exploded view of the panel light of FIG. 1.
Figure 3:
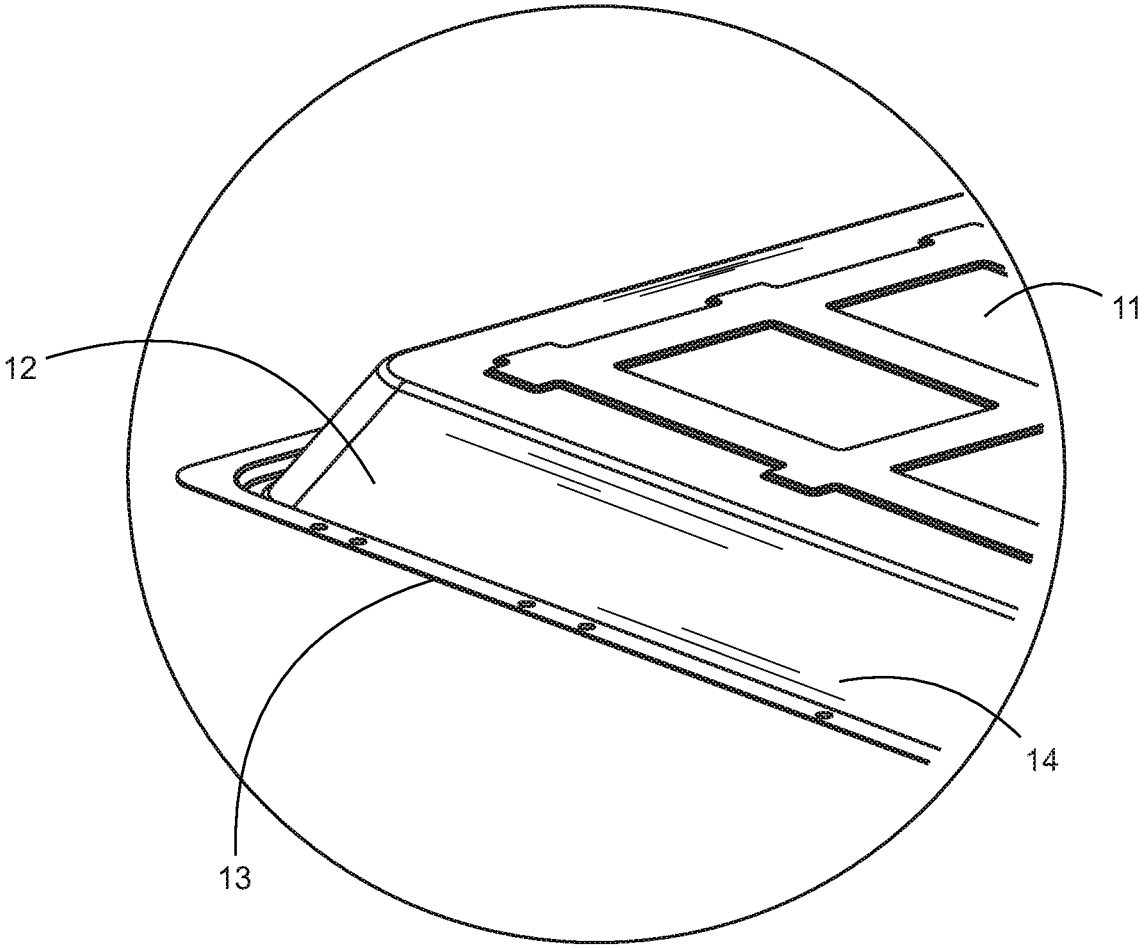
FIG. 3 is a partial enlarged view of A of FIG. 2.

As seen in FIG. 1 to FIG. 3, an embodiment of the present invention provides a lamp body structure 200 and a panel lamp 100 having the same. Optionally, the panel light 100 in this embodiment is a direct light emitting panel light; in other embodiments, the panel light 100 may also be a side light emitting panel light. The panel light 100 also includes a mid-frame structure 30 and a light source assembly 40 that projects light in a conductive state.

Figure 4:
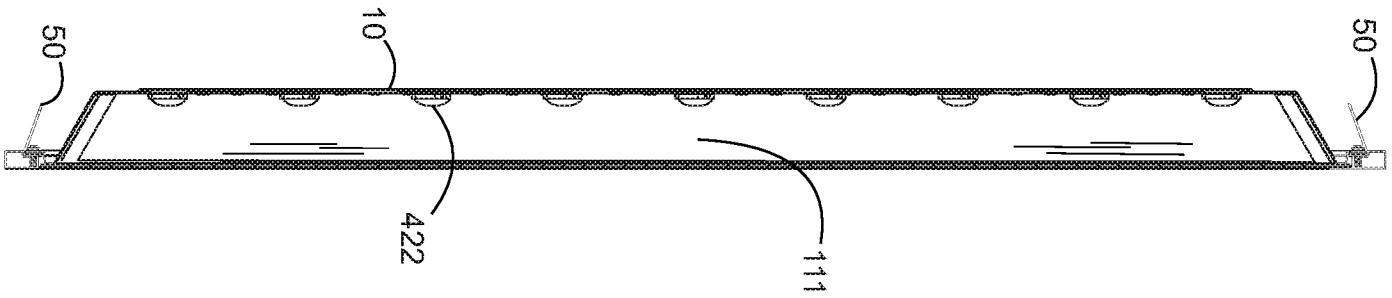
FIG. 4 is a cross-sectional view of the panel lamp of FIG. 1 along the central symmetry plane of the lamp panel.

The lamp body structure 200 includes a lamp panel 10 and a power supply assembly 20 that connects the lamp panel 10. Referring to FIG. 4, the lamp panel 10 includes a bottom plate 11 and a plurality of side plates 12 connected end to end. The bottom plate 11 and the side plates 12 together form a seating cavity 111 for an open cavity structure and for mounting the light source assembly 40. Specifically, the bottom plate 11 is laid flat. The side plate 12 is located at the opening of the seating cavity 111 along the parallel bottom plate 11 and extends horizontally away from the seating cavity 111 and forms the support plate 13. Alternatively, the lamp panel 10 may also be integrally formed by a stretching process of a metal material having good ductility. The metal material may be iron or an iron alloy. A support groove 14 is formed between the support plate 13 and the corresponding side plate 12, and the placement groove 14 is disposed adjacent to the placement cavity 111. The power supply assembly 20 is connected to a power source and supplies power to the light source assembly 40 in the housing chamber 111. Optionally, the power supply assembly 20 is elongated. The power supply assembly 20 is disposed laterally with respect to the bottom plate 11, and one end of the power supply assembly 20 is inserted into the seating groove 14 along the corresponding side plate 12 and abuts against the support plate 13. Optionally, one end of the power supply assembly 20 is detachably coupled to the support plate 13 to facilitate installation and removal of the power supply assembly 20.

The lamp tray 10 is laid flat, and a positioning groove 14 is formed between the support plate 13 and the corresponding side plate 12. The groove depth of the positioning groove 14 coincides with the thickness of the lamp plate 10, and one end of the power supply assembly 20 is placed into the positioning groove 14 Thus, the thickness of the side of the lamp panel 10 is utilized to reduce the overall thickness of the panel lamp 100, so that the overall structure of the panel lamp 100 is more novel and simpler, and also contributes to the packaging and transportation of the panel lamp 100.

In one embodiment, the angle between the support plate 13 and the corresponding side plate 12 in the seating groove 14 is greater than 90° and less than 180°. The groove wall of the positioning groove 14 is inclined with respect to the support plate 13 and inclined toward the inside of the positioning cavity 111, so that the installation space of the positioning groove 14 can be enlarged, which is advantageous for adapting the power supply components 20 of different sizes.

In one embodiment, the number of support plates 13 is adapted to the number of side plates 12, each support plate 13 being connected to a side plate 12 and forming a seating groove 14 between the respective side plates 12. Specifically, in the embodiment, the number of the side plates 12 and the support plates 13 are all four, so that the number of the installation grooves 14 is also four, and the four placement grooves 14 are arranged around the circumference of the placement cavity 111, thereby improving the number. The convenience of the power supply assembly 20 installation.

Figure 5:
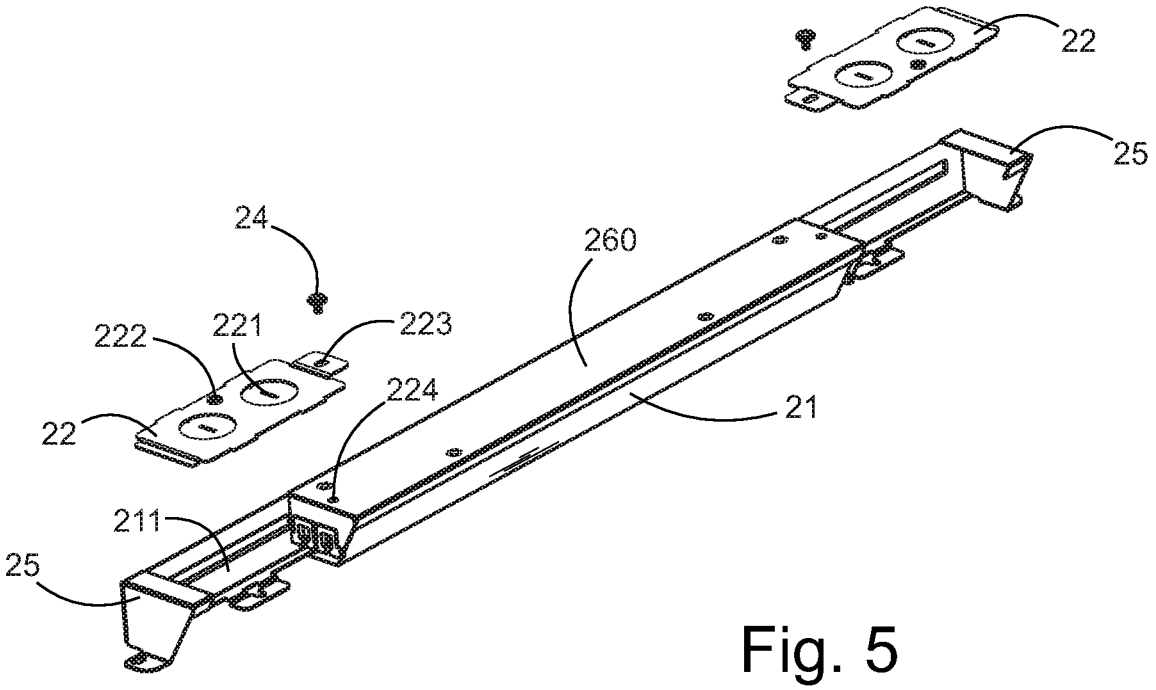
FIG. 5 is an exploded view of the power supply assembly of FIG. 2.
Figure 6:
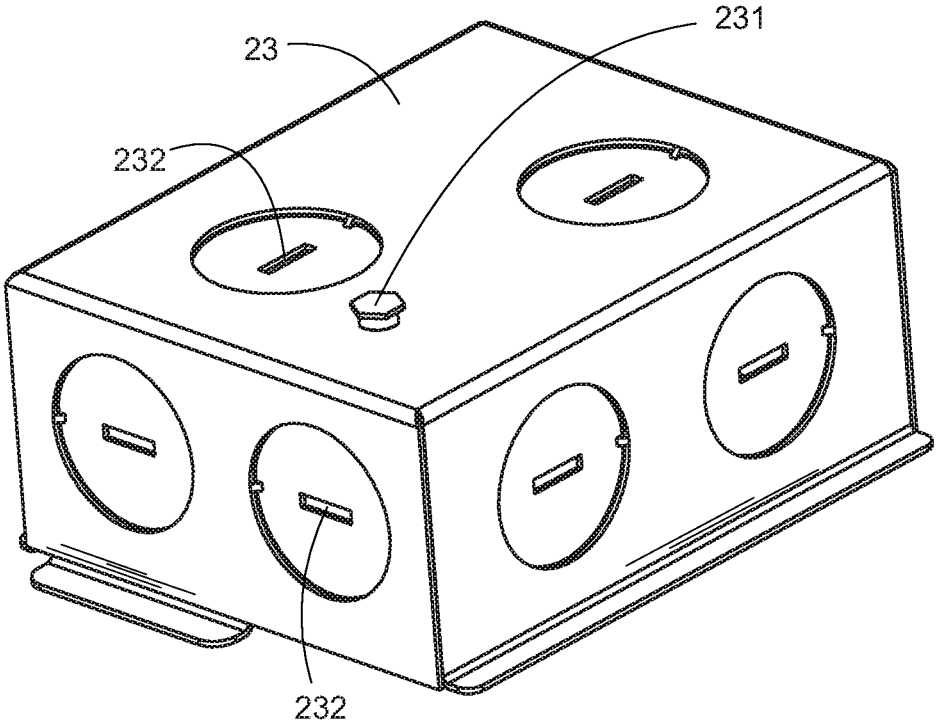
FIG. 6 is a perspective structural view of the power supply box of FIG. 2.

Referring to FIG. 5 to FIG. 6, in one embodiment, the power supply assembly 20 includes a power supply box 21 and a power supply circuit board that connects the external power supply and supplies power to the light source assembly 40. The power supply box 21 is provided with a power supply circuit board for mounting with a cavity. The power supply box 21 has a connection surface to which the support board 13 is connected, and a wiring surface 260 which is disposed opposite to the connection surface and which is connected to the power supply circuit board by external wires. Optionally, the power box 21 is provided with a connecting hole at the connecting surface, and a connecting threaded hole is formed at a position of the supporting plate 13 corresponding to the connecting hole, and the power box 21 can be detachably connected to the supporting plate 13 by the connecting bolt.

In one embodiment, the wiring surface 260 is not higher than the outer surface of the bottom plate 11, that is, the wiring surface 260 is flush with the outer surface of the bottom plate 11 outside the seating cavity 111, or the wiring surface 260 is lower than the outer surface of the bottom plate 11. The power supply assembly 20 is placed in the seating groove 14 so that the thickness of the panel light 100 can be minimized.

In one embodiment, the power supply assembly 20 further includes a first junction box 25 on the side of the lamp panel 10 and having a first terminal block 211. The first junction box 25 connects the outer panel of one of the side panels 12 with the first wiring. The cartridge 211 has an open structure and is provided for wires to be electrically connected to the power supply circuit board, and at least one of the first junction boxes 25 is provided. It can be understood that the first junction box 25 can be disposed at any position around the lamp panel 10 and connect the outer panel surface of any one of the side panels 12. The lower surface of the first junction box 25 is flush with the connection surface and is first The wiring compartment 211 is disposed adjacent to the seating cavity 111. Optionally, one end of the wire is electrically connected to the power source, and the other end of the wire is electrically connected to the power circuit board through the first terminal block 211. The wire can be provided in multiple pieces, and the wire can be a metal conduit.

Referring to FIG. 5, in one embodiment, the power supply assembly 20 further includes a wiring cover 22 that covers the opening of the first wiring compartment 211, and the wiring cover 22 is used to fix the wires.

In one embodiment, the outer surface of the wiring cover 22 is flush with the outer surface of the bottom plate 11, or the outer surface of the wiring cover 22 is lower than the outer surface of the bottom plate 11, thereby minimizing the overall thickness of the panel light 100.

In one embodiment, the wiring cover 22 is provided with a first wiring hole 221 that communicates with the first wiring compartment 211 and through which the wires pass. The first wiring holes 221 are disposed in pairs. The shape of the first wiring hole 221 is a rectangle, and in other examples, the shape of the first wiring hole 221 may also be circular or other shapes. By opening the first wiring hole 221 on the wiring cover 22, the wire is quickly connected to the power supply circuit board through the wiring cover 22, thereby improving the mounting efficiency. Further, when the installation is performed, the wiring cover 22 can be detached from the first junction box 25, and then the wires are passed through the corresponding first wiring holes 221 of the wiring cover 22, and the wires are connected to the first wiring compartment 211, thus connecting the wires to the power board. By providing the wiring cover 22 at the opening of the first wiring compartment 211, the thickness of the panel light 100 is not significantly increased, thereby making the entire panel light 100 compact and convenient to package.

In one embodiment, the first junction box 25 is provided with a first threaded hole 224 at the opening edge of the first terminal block 211, and one end of the wiring cover 22 is provided with a second threaded hole 223 corresponding to the position of the first threaded hole 224. The assembly 20 also includes a locating bolt 24 that is threaded at one end to the first threaded bore 224 and the second threaded bore 223. The screw connection between the wiring cover 22 and the first junction box 25 facilitates the removal and installation of the wiring cover 22.

In one embodiment, the first junction box 25 is provided in a pair, and the accommodating cavity is located between the two first wiring compartments 211. Optionally, the two first junction boxes 25 are integrally formed with the power supply box 21. Among them, one first wiring compartment 211 is set as a high voltage wiring compartment for connecting high voltage wires, and the other first wiring compartment 211 is set as a low voltage wiring compartment for connecting low voltage wires. It is convenient for users to select the corresponding wiring bin according to the actual use requirements.

It can be understood that when only one of the first junction boxes 25 is provided, the first wiring compartment 211 is simultaneously set as a high voltage wiring compartment and a low voltage wiring compartment.

In one embodiment, the opening of each of the first terminal compartments 211 is covered with a wiring cover 22. Two first wiring holes 221 are respectively formed on the two wiring covers 22.

In one embodiment, the grounding cover 22 is further provided with a ground screw hole 222 that communicates with the first terminal block 211. The ground screw hole 222 is spaced apart from the first wiring hole 221, and the ground screw hole 222 is used for the grounding wire which pass through and connect to the power supply board.

Referring to FIG. 6, the power supply assembly 20 further includes a second junction box 23 detachably connecting the wiring surface 260 and having a second wiring compartment 23 for electrically connecting the power source to the power supply circuit board, and the second junction box 23 is stacked with the power supply box 21. It can be understood that the surface of the box disposed outwardly of the second junction box 23 is provided with a second wiring hole 232 communicating with the second wiring compartment, and the second wiring holes 232 are disposed in pairs. The second wiring compartment can simultaneously perform the wiring operation of the high voltage wire and the low voltage wire. The second junction box 23 can be wired from a plurality of directions, so that the wiring space is large, and the user who needs a large wiring space can be selectively used; and because the overall size of the second junction box 23 is large, the user can easily manipulate the second junction box 23, thereby facilitating the installation and removal of the second junction box 23.

Further, the second junction box 23 is detachably connected to the power supply box 21, so that the second junction box 23 can be individually packaged as an option, or the package of the second junction box 23 can be separately disposed in the lamp body structure. The side of the box of 200, thereby saving the overall packaging space of the panel light 100.

In one embodiment, the power supply assembly 20 further includes a ground stud 231 that connects a surface of one of the second junction boxes 23 for ground connection.

In one embodiment, the panel light 100 further includes a middle frame structure 30. The light source assembly 40 is disposed in the placement cavity 111. The middle frame structure 30 is located at the opening of the placement cavity 111 and is used to fix the light source assembly 40 to the placement cavity 111. Alternatively, the middle frame structure 30 is made of a metal material such as aluminum.

Referring to FIG. 1 to FIG. 3, in one embodiment, the light source assembly 40 includes a reflective paper 41, an LED light-emitting strip 42 and a diffuser 43 disposed in the housing cavity 111. The LED light-emitting strips 42 are spaced apart from each other. The LED light strips 42 are both located between the reflective paper 41 and the diffuser plate 43, and the reflective paper 41 is applied to the bottom of the cavity of the seating cavity 111. Optionally, the cavity bottom of the placement cavity 111 is provided with a light slot corresponding to the position of each LED light bar 42. The reflective paper 41 is applied to the inner wall of each light groove, and each LED light bar 42 is disposed in the corresponding light groove.

In one embodiment, the LED light bar 42 includes an elongated light emitting circuit board 421, a light bead disposed on the light emitting circuit board 421, and a lens 422 covering the lamp cover. The plurality of light beads are disposed, and the number of the lenses 422 is The number of beads is set accordingly.

In one embodiment, the panel light 100 further includes a hook 50 for attaching the middle frame structure 30 to the outer structural member, the hook 50 being located on the same side of the support plate 13 as the power supply assembly 20. Specifically, the lamp body structure 200 can be suspended to the ceiling by the hooks 50. One end of the hook 50 is connected to the middle frame structure 30, and the other end of the hook 50 is connected to the ceiling. The hooks 50 are arranged in pairs. In the embodiment, the hooks 50 are provided with two pairs, and the two pairs of hooks 50 are symmetrically arranged.

The above are only the preferred embodiments of the present invention, and are not intended to limit the present invention. Any modifications, equivalents, and improvements made within the spirit and scope of the present invention should be included in the scope of the present invention.

The invention claimed is:

1. A lamp body structure for mounting a light source assembly and supplying power to the light source assembly, wherein the lamp body structure comprises:

a. a lamp panel comprising:

i. a bottom plate and a plurality of side plates connected end to end, wherein the bottom plate and each of the side plates together form a positioning cavity in an open cavity structure for mounting the light source assembly, wherein the side plate is located with a rim of the side plate at the opening of the positioning cavity extending parallel to the bottom plate and facing away from the seating cavity, and ii. a support plate, wherein the support plate forms a seating groove together with one side plate of the plurality of side plates; and b. a power supply assembly configured to connect to an external power supply, wherein the power supply supplies power to the light source assembly, wherein one end of the power supply assembly is inserted into a positioning groove along the corresponding side plate to abut the support plate.

2. The lamp body structure of claim 1, wherein an angle between the support plate and the corresponding side plate in the positioning groove is greater than 90° and less than 180°.

3. The lamp body structure of claim 1, wherein the number of the support plates is adapted to the number of the side plates, and wherein each of the support plates is respectively connected to a side plate, further comprising positioning grooves formed between the side plates.

4. The lamp body structure of claim 1, wherein the power supply unit comprises a power supply box and a power supply circuit board that connects the external power source and supplies power to the light source unit, wherein the power supply box has a receiving cavity for mounting the power circuit board; wherein the power supply box has a connecting surface connecting the supporting board and a wiring surface disposed opposite to the connecting surface and wherein external wires are connected to the power circuit board.

5. The lamp body structure of claim 4, wherein the outer plate of the bottom plate faces upward, and the wiring surface is not higher than the outer plate surface of the bottom plate.

6. The lamp body structure of claim 4, wherein the power supply assembly further comprises a first junction box on one side of the lamp panel having a first wiring compartment, wherein the first junction box connects on an outer panel surface of one of the side panels, wherein the first wiring compartment has an open structure configured to allow an external wire to pass through to electrically connect to the power circuit board.

7. The lamp body structure of claim 6, wherein the power supply assembly further comprises a wiring cover covering the opening of the first wiring compartment, the wiring cover configured for fixing an external wire.

8. The lamp body structure of claim 7, wherein an outer surface of the wiring cover is not higher than an outer surface of the bottom plate.

9. The lamp body structure of claim 7, wherein the opening edge of a first terminal block is provided with a first threaded hole, and one end of the wire cover is opened corresponding to the position of the first threaded hole, wherein the threaded hole and the power supply assembly further includes a positioning bolt screwed to the first threaded hole and the second threaded hole at one end.

10. The lamp body structure of claim 7, wherein the wiring cover is provided with a first wiring hole that communicates with the first wiring compartment and is used for external wires to pass through, wherein the wiring holes are set in pairs.

11. The lamp body structure of claim 10, wherein the wire cover is further provided with a ground screw hole communicating with the first terminal block, and the ground screw hole is spaced apart from the first terminal hole settings.

12. The lamp body structure of claim 11, wherein the first junction box is provided in a pair, and wherein the two first junction boxes are respectively connected to end faces of the power supply box, wherein each of the two first junction boxes is located in the positioning slot, and further comprising an accommodating cavity located between the two first wiring compartments.

13. The lamp body structure of claim 12, wherein the opening of each of the first terminal compartments is covered with the wire cover.

14. The lamp body structure of claim 4, wherein the power supply assembly further comprises a second junction box detachably connecting the wiring surface and having a second wiring compartment, wherein the second junction box is used for an external power source electrically connected to the power circuit board, and wherein the second junction box is stacked with the power box.

15. The lamp body structure of claim 14, wherein a surface of the casing of the second junction box is provided with a second wiring hole for fixing an external wire arranged in a pair.

16. The lamp body structure of claim 14, wherein the power supply assembly further comprises a ground stud connecting a surface of one of the second junction boxes and connected by an external grounding wire.

17. The lamp body structure of claim 1 further including: a light source assembly, and a middle frame structure, wherein the light source assembly is disposed in the positioning cavity, wherein a middle frame structure is located at an opening of the seating cavity, wherein the light source assembly is fixed to the seating cavity.

18. The lamp body structure of claim 17, wherein the light source assembly further includes: a reflective paper, LED light-emitting strips and a diffusion plate which are sequentially disposed in the positioning cavity, wherein the LED light-emitting strips are arranged in intervals, wherein each of the LED light strips are respectively located between the reflective paper and the diffuser plate, wherein the reflective paper is connected to a cavity bottom of the placement cavity.

19. The lamp body structure of claim 17, wherein the panel light further comprises a hook for connecting the middle frame structure to an outer structural member, wherein one end of the hook connecting the middle frame structure the other end of the hook is connected to an outer structural member, and wherein the hook and the power supply assembly are located on the same side of the support plate.

* * * * *